US006388859B1

(12) United States Patent
Turner et al.

(10) Patent No.: US 6,388,859 B1
(45) Date of Patent: May 14, 2002

(54) SHOCK RESISTANT BREAKER SHUNT TRIP

(75) Inventors: David Curtis Turner, Imperial, PA (US); Christopher John Conway, Wilmot, NH (US); David Michael Olszewski, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/568,443

(22) Filed: May 10, 2000

(51) Int. Cl.[7] ..... H01H 73/00

(52) U.S. Cl. ..... 361/115; 361/193; 335/192; 335/254

(58) Field of Search ..... 361/54, 102, 114, 361/115, 191, 192, 193; 335/14, 177, 178, 179, 174, 176, 192, 278, 241, 242, 253, 254, 259, 274

(56) References Cited

U.S. PATENT DOCUMENTS 4,710,739 A * 12/1987 Heyne et al. ..... 335/174

* cited by examiner

*Primary Examiner*—Ronald W. Leja
(74) *Attorney, Agent, or Firm*—Martin J. Moran

(57) ABSTRACT

A shunt trip assembly having a tripping solenoid and a locking solenoid selectively blocks movement of the tripping solenoid to prevent inappropriate tripping of a circuit breaker during shock loading thereof. The tripping solenoid includes a tripping plunger that is longitudinally translatable along a tripping path to operatively engage a trip button of the circuit breaker. The locking solenoid includes a locking plunger that is selectively translatable along a locking path to selectively block movement of the tripping plunger, the locking path being substantially perpendicular to the tripping path. A longitudinally-facing first abutment surface on the tripping plunger is engaged by the locking plunger to prevent inappropriate movement of the tripping plunger during shock loading. A peripherally-disposed second abutment surface on the tripping plunger prevents misconfiguration of the shunt trip assembly after the shunt trip assembly has been deenergized. The tripping solenoid and locking solenoid are simultaneously energized and deenergized.

4 Claims, 2 Drawing Sheets

SHOCK RESISTANT BREAKER SHUNT TRIP

BACKGROUND OF THE INVENTION

1. Field of the Invention

The present invention relates generally to a shunt trip assembly for a circuit breaker and, more particularly, to a shunt trip assembly that is selectively lockable to prevent inappropriate shock-based tripping of a circuit breaker.

2. Description of the Related Art

Numerous types of circuit breakers are known and understood in the relevant art. Among the purposes for which circuit breakers are provided is to interrupt an electrical circuit on command or according to certain criteria. For instance, a given circuit breaker may be configured to interrupt a circuit during one or more specific overload conditions or under other conditions.

Circuit breakers typically include a set of movable electrical contacts that are placed into a compressive abutting relationship with a set of stationary contacts to complete an electrical circuit. If it is desired to interrupt the electrical circuit, the movable contacts are moved away from the stationary contacts by a tripping mechanism to break the electrical connection between the movable and stationary contacts and to interrupt the electrical circuit. Numerous types of tripping mechanisms exist and are often tailored to meet specific needs of particular applications.

For instance, a given circuit breaker may include a trip mechanism with a delayed trip feature provided by a bimetallic strip as well as an instantaneous trip implemented by a magnetic device. In multiple-pole circuit breakers, such tripping often involves rotation of a trip bar to unlatch the circuit breaker mechanism and rapidly separate the moveable contacts from the stationary contacts to interrupt the electrical circuit. In this regard, it is often desirable to additionally provide a trip button to manually rotate the trip bar to unlatch the circuit breaker mechanism during certain conditions. Such a trip button may be depressed manually or may be depressed by a tripping solenoid that is electrically operated by a remote button.

While such tripping solenoids operate reliably under many conditions, circuit breaker trip mechanisms employing such tripping solenoids are often subject to inadvertent tripping during shock loading of the circuit breaker. As is understood in the relevant art, a solenoid includes a plunger that is axially movable with respect to the solenoid housing. During shock loading of the circuit breaker, the plunger of the tripping solenoid can be induced to move with respect to the solenoid housing, which can result in the circuit breaker being tripped even though the tripping solenoid was in a deenergized condition. Such inappropriate tripping of a circuit breaker is to be particularly avoided in critical applications in which loss of power would create an unsafe or harmful situation. It is thus desired to provide a circuit breaker shunt trip apparatus that is resistant to shock loading yet is capable of engaging on command the trip button of a circuit breaker trip mechanism.

SUMMARY OF THE INVENTION

In accordance with the invention, a shock resistant breaker shunt trip apparatus is provided that includes a tripping solenoid and a locking solenoid that are in a substantially perpendicular operative arrangement with one another and are energized simultaneously to cause the plunger of the tripping solenoid to engage the trip button of a circuit breaker trip mechanism. The locking solenoid includes a locking plunger that is in mechanical interference with a longitudinally-oriented first abutment surface formed on the tripping plunger of the tripping solenoid. Such mechanical interference prevents the tripping plunger from engaging the trip button unless the locking solenoid is energized. When it is desired to trip the circuit breaker, the tripping solenoid and the locking solenoid are energized to cause the locking plunger of the locking solenoid to move out of mechanical interference with the first abutment surface of the tripping plunger and to translate the tripping plunger into contact with the trip button to trip the circuit breaker. A peripherally-disposed second abutment surface is provided on the tripping plunger to prevent the locking plunger from returning to its extended position prior to the tripping plunger returning to its retracted position, which might otherwise interfere with the function of the device.

An aspect of the invention is to provide a shunt trip assembly for a circuit breaker, the general nature of which can be stated as including a tripping solenoid having a tripping plunger, the tripping plunger being movable along a tripping path between a retracted position and an extended position, the tripping path having a tripping length, a locking solenoid having a locking plunger, the locking plunger being movable along a locking path between an extended position and a retracted position, the locking path having a locking length, the locking plunger in the extended position being disposed in mechanical interference with the tripping plunger, and the locking plunger in the retracted position being disposed out of mechanical interference with the tripping plunger.

Another aspect of the present invention is to provide a method of controlling the movement of a tripping plunger of a tripping solenoid in a shunt trip assembly of a circuit breaker, the tripping plunger being moveable along a tripping path between a retracted position and an extended position, the general nature of which can be stated as including the step of blocking movement of the tripping plunger from the retracted position to the extended position.

Another aspect of the invention includes providing, in combination, a circuit breaker and a shunt trip assembly, the general nature of which can be stated as including a circuit breaker and a shunt trip assembly operatively connected with the circuit breaker, the shunt trip assembly including a tripping solenoid having a tripping plunger, the tripping plunger being movable along a tripping path between a retracted position and an extended position, a locking solenoid having a locking plunger, the locking plunger being movable between an extended position and a retracted position, the locking plunger in the extended position being disposed in the tripping path, and the locking plunger in the retracted position being disposed out of the tripping path.

These and other aspects and advantages of the present invention will be more readily understood from the following description.

BRIEF DESCRIPTION OF THE DRAWINGS

Similar numerals refer to similar parts throughout the specification.

DESCRIPTION OF THE PREFERRED EMBODIMENT

Figure 1:
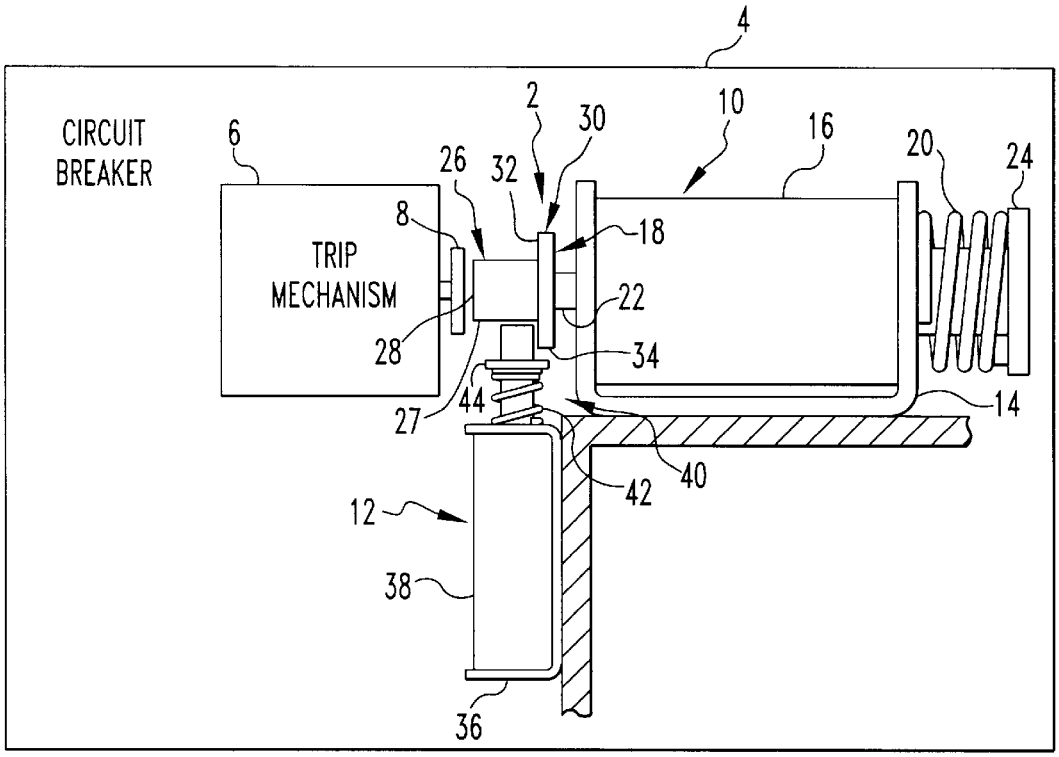
FIG. 1 is a schematic view of a circuit breaker incorporating a shunt trip assembly in accordance with the present invention and showing the shunt trip assembly in a deenergized condition.
Figure 2:
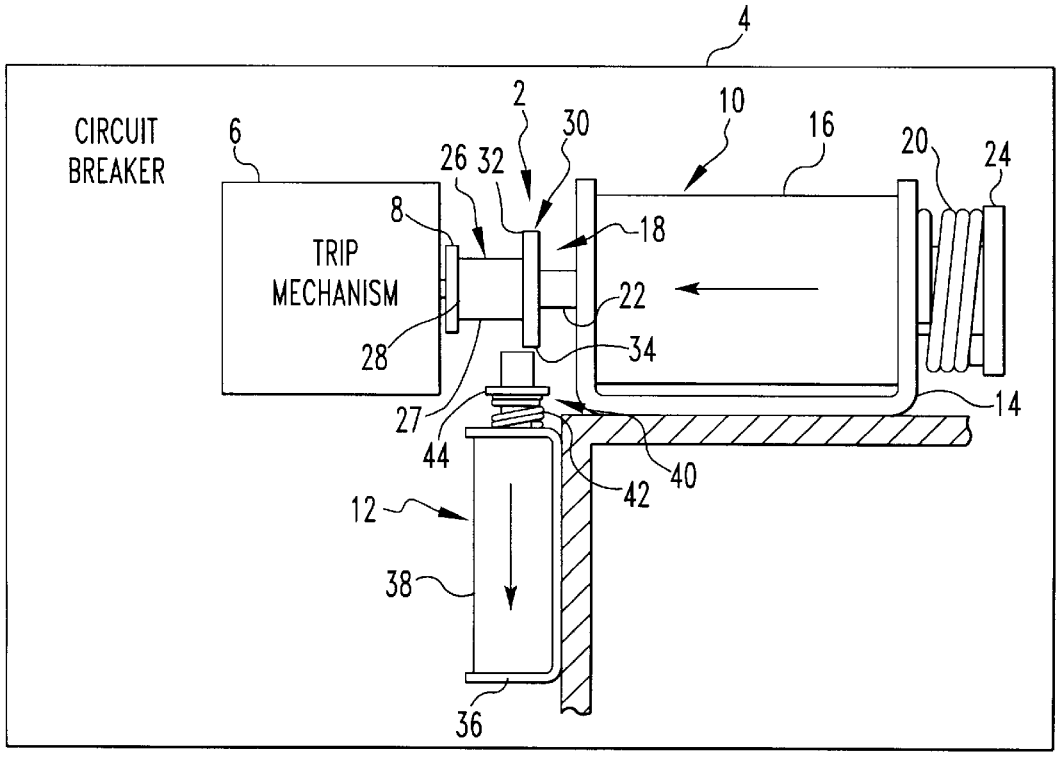
FIG. 2 is a view similar to FIG. 1, except showing the shunt trip assembly in an energized condition.

A shunt trip assembly 2 of the present invention is indicated generally in FIGS. 1 and 2. The assembly 2 is configured to trip on demand a circuit breaker 4, yet is advantageously configured to obviate the likelihood of inadvertent tripping of the circuit breaker 4 during shock loading. The circuit breaker 4 may be any of a wide variety of circuit breakers of the type known and understood in the relevant art, and preferably includes a circuit breaker trip mechanism 6 that is operated by a trip button 8. As will be set forth more fully below, the trip button 8 is selectively engaged by the assembly 2 to trip the circuit breaker 4.

The assembly 2 includes a tripping solenoid 10 and a locking solenoid 12 that are operatively oriented in a substantially perpendicular relation with one another.

While it is preferred that the tripping solenoid 10 and the locking solenoid 12 are both mounted on a portion of the housing internal to the circuit breaker 4, it is understood that in other configurations the shunt trip assembly 2 may be disposed outside the circuit breaker 4 without departing from the spirit of the present invention. Inasmuch as the trip button 8 is most typically disposed inside the circuit breaker 4, it is preferred that the tripping solenoid 10 and the locking solenoid 12 are likewise disposed internally within the circuit breaker 4 and are fixedly attached to stationary structures therein.

The tripping solenoid 10 includes a tripping housing 14, a tripping coil 16, a tripping plunger 18, and a returning spring 20. The tripping housing 14 is a structural member that is securely mounted on stationery structures within the interior of the circuit breaker 4 and carries the tripping coil 16 thereon. The tripping coil 16 is a solenoid coil of the type known and understood in the relevant art which includes a plurality of turns that, when energized, generate a magnetic field having field lines directed through a central channel of the tripping coil 16. The tripping plunger 18 is axially moveable through the central channel and includes a magnetically permeable core that is acted upon by the magnetic field generated by the tripping coil 16. As will be set forth more fully below, when the tripping coil 16 is energized, the tripping plunger 18 is longitudinally accelerated into engagement with the trip button 8 to trip the circuit breaker 4.

More specifically, the tripping plunger 18 includes an elongated tripping shaft 22 on which the core is mounted, with the tripping shaft 22 including a substantially circular end plate 24 mounted at one end thereof and a retention member 26 at the opposite end thereof. The returning spring 20 is disposed on the tripping plunger 18 between the end plate 24 and the tripping housing 14. The returning spring 20 is a compression coil spring that biases the tripping plunger 18 to a retracted position as is depicted generally in FIG. 1. When the tripping coil 16 is energized in a fashion that will be set forth more fully below, the magnetic field generated by the tripping coil 16 provides a magnetic force on the tripping plunger 18 that overcomes the biasing force of the returning spring 20 to translate the tripping plunger 18 in a longitudinal direction toward an extended position that is depicted generally in FIG. 2. A tripping path is thus defined as the path occupied by the tripping plunger 18 as it travels between the retracted position (FIG. 1) and the extended position (FIG. 2.) When the tripping coil 16 is deenergized, the biasing force of the returning spring 20 against the endplate 24 returns the tripping plunger 18 along the tripping path from the extended position (FIG. 2) to the retracted position (FIG. 1.)

The retention member 26 includes a substantially cylindrical barrel 27 terminating at a substantially circular striking end 28 at one end thereof and includes an annular shoulder 30 extending outwardly therefrom at the end opposite the striking end 28. The shoulder 30 includes an annular longitudinally facing first abutment surface 32 thereon that faces substantially in the same direction as the striking end 28. The shoulder 30 additionally includes an arcuate peripherally-disposed second abutment surface 34 along the periphery thereof that is substantially perpendicular to the first abutment surface 32.

The striking end 28 is configured to operatively engage the trip button 8 when the tripping solenoid 10 is energized. Inasmuch as the first abutment surface 32 operates as a stopping surface to selectively prevent movement of the tripping plunger 18 toward the trip button 8 as will be set forth more fully below, the first abutment surface 32 thus generally faces the trip button 8. It can also be seen that the first abutment surface 32 includes an imaginary plane oriented substantially perpendicular to the tripping path. The second abutment surface 34 faces in a direction generally perpendicular to the direction of movement of the tripping plunger 18 along the tripping path.

The locking solenoid 12 includes a locking housing 36, a locking coil 38, and a locking plunger 40. The locking solenoid 12 is a conventional solenoid of the type known and understood in the relevant art in which the locking coil 38 generates a magnetic field when energized to translate the locking plunger 40 in a longitudinal direction.

More specifically, the locking plunger 40 includes a substantially annular retention plate 44 extending outwardly therefrom and a locking spring 42 disposed on the locking plunger 40 between the locking housing 36 and the retention plate 44. The locking plunger includes a magnetic core that is acted upon by the magnetic field generated by the locking coil 38. As is understood in the relevant art, the locking spring 42 is a compression coil spring that biases the locking plunger 40 to an extended position when the locking coil 38 is deenergized, as is indicated generally in FIG. 1. When the locking coil 38 is energized, however, the magnetic field generated thereby acts on the magnetic core of the locking plunger 40 to overcome the spring bias of the locking spring 42 to move the locking plunger 40 to a retracted position as is indicated generally in FIG. 2. The locking plunger 40 thus moves along a locking path defined as the path occupied by the locking plunger 40 when moving between the extended position when the locking solenoid 12 is deenergized (FIG. 1) and the retracted position when the locking solenoid 12 is energized (FIG. 2.)

It can be seen that the tripping plunger 18 travels in a direction that is substantially perpendicular to the movement of the locking plunger 40. Similarly, the tripping path is substantially perpendicular to the locking path. It can further be seen, therefore, that the tripping path and the locking path at least partially coincide, and the tripping plunger 18 and the locking plunger 40 are advantageously in mechanical interference with one another at the region of coincidence. During such mechanical interference, a portion of the locking plunger 40 is disposed in the tripping path adjacent the first abutment surface 32 when the tripping plunger is substantially in the retracted position. Such mechanical interference between the locking plunger 40 and the tripping plunger 18 blocks movement of the tripping plunger 18 from the retracted position to the extended position.

If the tripping plunger 18 is urged from the deenergized, retracted position depicted in FIG. 1 toward the extended position without first retracting the locking plunger 40 from its position adjacent the first abutment surface 32, such as occurs during shock loading, the first abutment surface 32 collides with the portion of the locking plunger 40 adjacent thereto. The locking plunger 40 thus advantageously blocks movement of the tripping plunger 18 from the retracted position to the extended position when the tripping plunger 18 and the locking plunger 40 are in mechanical interference with one another. It can be seen, therefore, that when the tripping solenoid 10 and the locking solenoid 12 are both in the deenergized condition depicted in FIG. 1, the locking plunger 40 extends at least partially into the tripping path, and the locking plunger 40 and the tripping plunger 18 are thus in mechanical interference with one another.

It can likewise be seen that the locking plunger 40 in the extended position advantageously blocks movement of the tripping plunger 18 from the retracted position to the extended position. Such blocking advantageously obviates the potential for the tripping plunger 18 to move toward and engage the trip button 8 during shock loading of the circuit breaker 4. Similarly, the tripping plunger 18 is permitted to move along the tripping path to engage the trip button 8 only when the locking solenoid 12 is energized and the locking plunger 40 has been removed from the tripping path.

Once the locking solenoid 12 has been energized and the locking plunger 40 has been removed from the tripping path, it can be seen that upon energizing the tripping solenoid 10 the tripping plunger 18 can be translated from the retracted position to the extended position along the tripping path to engage the trip button 8 to trip the circuit breaker 4. In energizing the locking solenoid 12 and the tripping solenoid 10, it is most preferable to energize the locking solenoid 12 and the tripping solenoid 10 simultaneously, with the locking solenoid 12 and the tripping solenoid 10 still more preferably being electrically connected with one another such that a common signal energizes them both.

In order to ensure the smooth operation of the assembly 2 when the tripping and locking solenoids 10 and 12 are simultaneously energized, it is preferred to configure the locking solenoid 12 such that the locking plunger 40 accelerates more quickly than the tripping plunger 18. Such configuration ensures that the locking plunger 40 is removed from the tripping path before the tripping plunger 18 has translated across the locking path.

In this regard, the locking plunger 40 may be configured to have a smaller mass than that of the tripping plunger 18. Alternatively, or in addition thereto, the locking spring 42 may be configured to have a spring constant substantially less than that of the returning spring 20. Still alternatively, or in addition thereto, the locking coil 38 may be configured to produce a magnetic field proportionately greater than that produced by the tripping coil 16 when comparing the relative masses of the locking plunger 40 and the tripping plunger 18. Still further, or in addition thereto, the locking plunger 40 may be configured such that the distance it moves along the locking path in departing from the tripping path may be less than the distance moved by the tripping plunger 18 in moving along the tripping path into the locking path.

It is further preferred that when the locking solenoid 12 and the tripping solenoid 10 are both in the deenergized condition as is shown generally in FIG. 1, the first abutment surface 32 is at least nominally spaced from the arcuate surface of locking plunger 40. By providing such a space, an increment of time exists after energizing the tripping and locking solenoids 10 and 12 during which the locking plunger 40 can move out of the tripping path before the first abutment surface 32 passes through the locking path. By providing the aforementioned space, and by configuring the locking solenoid 12 such that the locking plunger 40 accelerates faster than the tripping plunger 18, the locking solenoid 12 and the tripping solenoid 10 can be energized simultaneously without any risk that the first abutment surface 32 will collide with the locking plunger 40.

Once the tripping solenoid 10 has traveled along the tripping path to the extended position and has operatively engaged the trip button 8 to trip the circuit breaker 4, it is preferred that the tripping solenoid 10 and the locking solenoid 12 immediately be deenergized to prevent damage thereto resulting from overheating and from other effects. It is thus preferred that the operation of the circuit breaker trip mechanism 6 by the tripping plunger 18 additionally operates a microswitch that deenergizes the locking solenoid 12 and the tripping solenoid 10 upon the tripping of the circuit breaker 4. It is understood, however, that alternate methods and structures may be employed to deenergize the locking solenoid 12 and the tripping solenoid 10 upon the tripping of the circuit breaker 4 without departing from the concept of the present invention.

Inasmuch as it is preferred that the locking solenoid 12 and the tripping solenoid 10 be electrically connected with one another such that they are simultaneously energized, it can be seen that the locking solenoid 12 and the tripping solenoid 10 will similarly be simultaneously deenergized. When the magnetic fields generated by the tripping coil 16 and the locking coil 38 are simultaneously extinguished, the returning spring 20 and the locking spring 42 will simultaneously bias the tripping plunger 18 and the locking plunger 40, respectively, back to the positions depicted in FIG. 1. It is thus preferred that the tripping plunger 18 be removed from the locking path prior to the locking plunger 40 entering the tripping path, otherwise the locking plunger 40 may interfere with the proper operation of the tripping plunger 18.

As is best shown in FIG. 2, when the tripping plunger 18 is in the extended position, the second abutment surface 34 is disposed in the locking path and is in mechanical interference with the locking plunger 40. The second abutment surface 34 thus prevents the locking plunger 40 from returning to its extended, deenergized condition prior to second abutment surface 34 being removed from the locking path. Even if the locking plunger 40 seeks to return to its extended position prior to the tripping plunger 18 being removed from the locking path, the end of the locking plunger 40 will merely abut and ride along the second abutment surface 34 as the tripping plunger 18 translates toward the retracted position sufficiently that the second abutment surface 34 has been removed from the locking path and the tripping plunger 18 has been removed from mechanical interference with the locking plunger 40.

It can be seen, therefore, that the second abutment surface 34 prevents the assembly 2 from becoming misconfigured with the locking plunger 40 interposed between the shoulder 30 and the tripping housing 14 after the assembly 2 is deenergized. Additionally, by disposing the second abutment surface 34 on the tripping plunger 18, the second abutment surface 34 is positioned in the locking path substantially when the tripping solenoid 10 is energized. Likewise, the second abutment surface 34 is removed from the locking path substantially when the tripping solenoid 10 is deenergized, which illustrates the simplicity and ingenuity with which the assembly 2 is configured.

It is understood, of course, that numerous other configurations of the locking solenoid 12, the tripping solenoid 10, and the retention member 26 are possible without departing from the concept of the present invention. For instance, an alternate embodiment of a tripping plunger 122 and a locking plunger 140 are indicated generally in FIGS. 3 and 4.

More specifically, the tripping plunger 122 is a substantially cylindrical member terminating at a substantially circular striking end 128 and is formed with a notch 129 that is spaced from the striking end 128. The notch 129 provides a substantially planar longitudinally-facing first abutment surface 132 that faces generally in the same direction as the striking end 128 and a peripherally-disposed second abutment surface 134 which is the outer arcuate surface of the tripping plunger 122.

Figure 3:
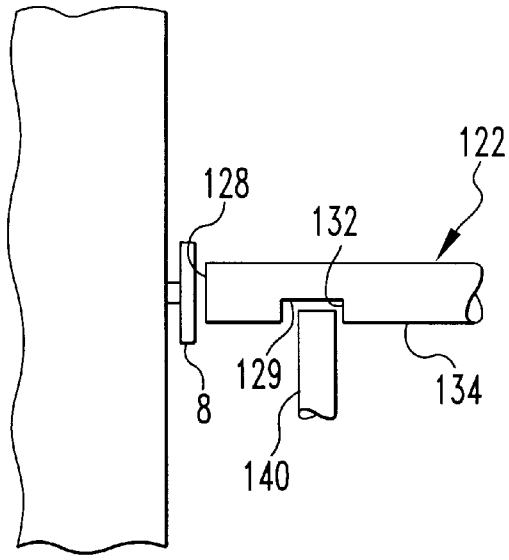
FIG. 3 is a schematic view of an alternate embodiment of the tripping plunger and locking plunger of the shunt trip assembly in a deenergized condition.
Figure 4:
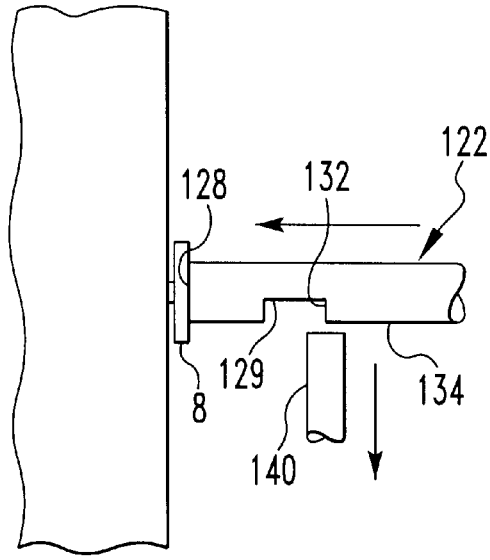
FIG. 4 is a view of similar to FIG. 3, except showing the alternate embodiment in an energized condition.

When the locking and tripping solenoids employing the locking plunger 140 and the tripping plunger 122 are in the deenergized condition, the end of the locking plunger 140 is received in the notch 129 and is preferably at least nominally spaced from the first abutment surface 132, as is depicted in FIG. 3. The locking plunger 140 is thus positioned in the tripping path in such condition. When the solenoids employing the locking plunger 140 and the tripping plunger 122 are energized, the locking plunger 140 is translated along the locking path to remove it from the notch 129, and the tripping plunger 122 is translated along the tripping path to engage the trip button 8. When the solenoids employing the tripping plunger 122 and the locking plunger 140 are deenergized, the second abutment surface 134 retains the locking plunger 140 in a position out of the tripping path until the tripping plunger 122 has returned sufficiently to its retracted position.

The shunt trip assembly 2 of the present invention thus prevents inappropriate tripping of circuit breaker 4 due to shock loading, but also permits circuit breaker 4 to be tripped on command. Additionally, the shunt trip assembly 2 of the present invention advantageously includes a pair of solenoids 10 and 12 that are wired together and are energized simultaneously, which reduces the complexity of the present invention and concomitantly reduces the likelihood of failure thereof. Still further, the shunt trip assembly 2 of the present invention is arranged such that it does not become misconfigured when the solenoids 10 and 12 are simultaneously deenergized, which permits for rapid resetting of circuit breaker 4 as needed without an additional requirement that the shunt trip assembly 2 of the present invention be independently reset or checked for proper operation.

While particular embodiments of the present invention have been described herein, it is understood that various changes, additions, modifications, and adaptations may be made without departing from the scope of the present invention, as set forth in the following claims.

What is claimed is:

1. A method of controlling the movement of a tripping plunger of a tripping solenoid in a shunt trip assembly of a circuit breaker, the tripping plunger being movable along a tripping path between a retracted position and an extended position, the method comprising the steps of:

blocking movement of the tripping plunger from the retracted position to the extended position;

in which the step of blocking includes the step of positioning a locking plunger of a locking solenoid in the tripping path;

further comprising the step of removing the locking plunger from the tripping path, the locking plunger being movable along a locking path between an extended position and a retracted position;

in which the step of removing includes the steps of energizing the locking solenoid and moving the locking plunger from the extended position to the retracted position; and further comprising the steps of energizing the tripping solenoid, moving the tripping plunger from the retracted position to the extended position, and preventing movement of the locking plunger from the retracted position to the extended position.

2. The method as set forth in claim 1, in which the step of preventing movement includes the step of placing a second abutment surface in the locking path.

3. The method as set forth in claim 2, further comprising the steps of deenergizing the locking solenoid and deenergizing the tripping solenoid, the steps of deenergizing the locking and tripping solenoids occurring substantially simultaneously.

4. The method as set forth in claim 3, in which the step of deenergizing the tripping solenoid includes the steps of moving the tripping plunger from the extended position to the retracted position and removing the second abutment surface from the locking path.

* * * * *